US007480959B2

(12) United States Patent
Bott et al.

(10) Patent No.: US 7,480,959 B2
(45) Date of Patent: Jan. 27, 2009

(54) VACUUM CLEANER COMPRISING A BASE COMPARTMENT FOR ATTACHMENTS

(75) Inventors: Erich Bott, Hollstadt (DE); Roland Illig, Heustreu (DE); Anja Niedergesaess, Ebenhausen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 448 days.

(21) Appl. No.: 10/539,816

(22) PCT Filed: Dec. 5, 2003

(86) PCT No.: PCT/EP03/13785

§ 371 (c)(1),
(2), (4) Date: Dec. 5, 2005

(87) PCT Pub. No.: WO2004/058030

PCT Pub. Date: Jul. 15, 2004

(65) Prior Publication Data

US 2006/0156506 A1 Jul. 20, 2006

(30) Foreign Application Priority Data

Dec. 20, 2002 (DE) ..... 102 60 226

(51) Int. Cl.
*A47L 9/00* (2006.01)

(52) U.S. Cl. ..... 15/323; 15/327.2; 15/327.7

(58) Field of Classification Search ..... 15/323, 15/327.2, 327.1; *A47L 9/00*
See application file for complete search history.

(56) References Cited

U.S. PATENT DOCUMENTS

| | | | |
|---|---|---|---|
| 2,608,709 | A | 12/1952 | Benjamin |
| 3,200,432 | A | 8/1965 | Voegeli et al. |
| 3,217,350 | A | 11/1965 | Waters et al. |
| 4,996,736 | A | 3/1991 | Nusser et al. |
| 5,604,953 | A | 2/1997 | Castwall et al. |
| 5,699,585 | A | 12/1997 | Tomooka et al. |

FOREIGN PATENT DOCUMENTS

| | | | |
|---|---|---|---|
| EP | 1 208 786 | | 5/2002 |
| JP | 11107653 | A * | 4/1999 |

OTHER PUBLICATIONS

International Search Report for PCT/EP2003/013785.

* cited by examiner

*Primary Examiner*—David A Redding
(74) *Attorney, Agent, or Firm*—Russell W. Warnock; James E. Howard

(57) ABSTRACT

A vacuum cleaner comprising a housing (1), in which a dust compartment (5), which can be closed by a dust compartment cover and is designed to receive a dust interceptor (6), and a fan compartment (7) for receiving a motor-driven fan unit (8) are configured. The vacuum cleaner also comprises a receiving compartment (16) for attachments (17), which extends below the dust compartment (5) and/or the fan compartment (7) and can be accessed by means of an opening (18) in the housing (1). The aim of the invention is to permit users to remove attachments (17) easily from the receiving compartment (16) that is located below the dust compartment (5) and the fan compartment (7). To achieve this, the opening(s) (18) is/are provided in a lateral wall (19) of the housing (1). This permits attachments (17) to be removed, without bringing the vacuum cleaner out of its normal operating position.

23 Claims, 2 Drawing Sheets

VACUUM CLEANER COMPRISING A BASE COMPARTMENT FOR ATTACHMENTS

Figure 1:
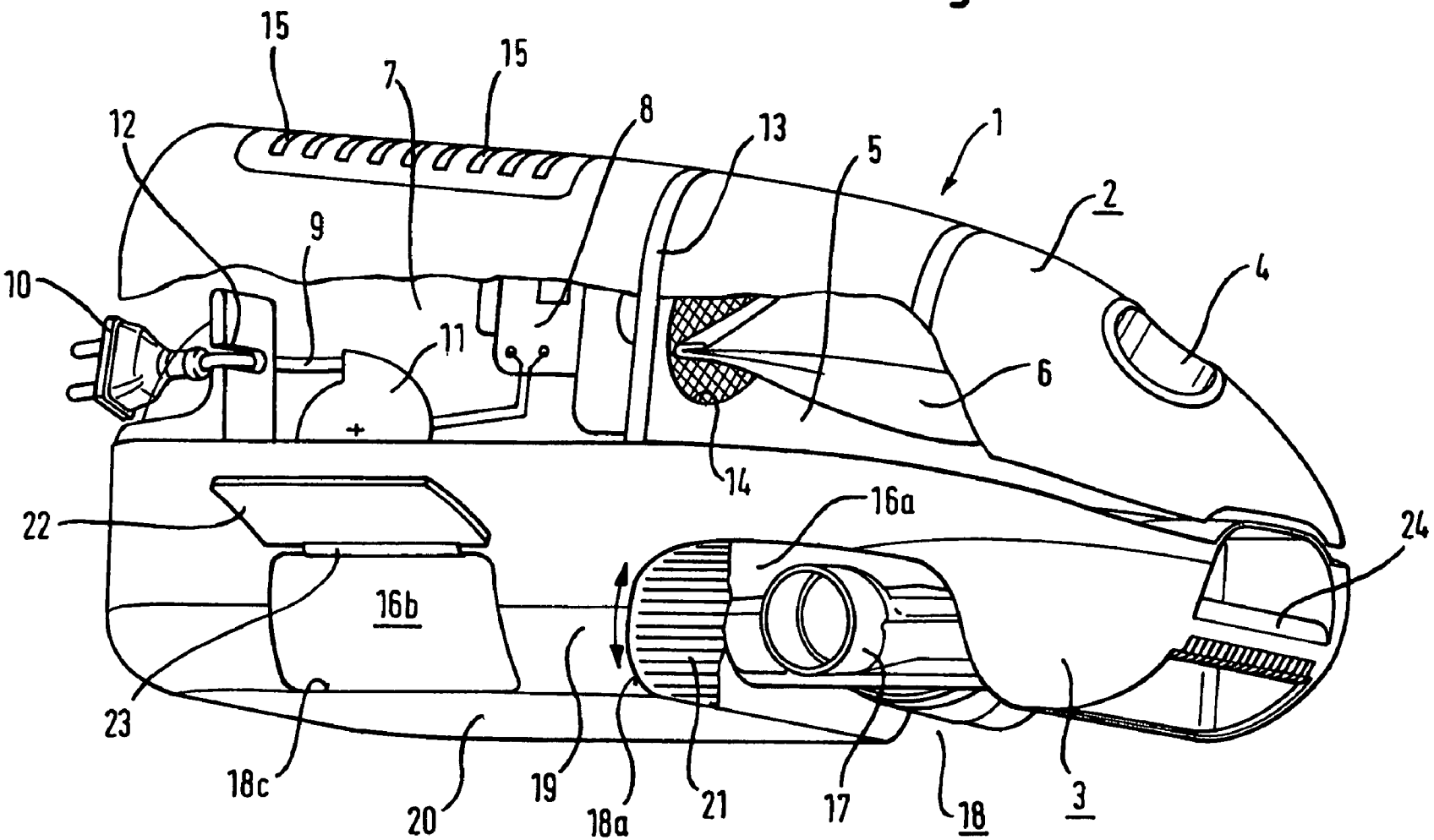

The invention relates to a vacuum cleaner according to the introductory part of patent claim 1.

A vacuum cleaner according to category is known from DE 39 04 394 A1. This vacuum cleaner comprises a vacuum cleaner housing which has a dust chamber and a motor chamber connected with the dust chamber. The housing has a compartment, which extends over the underside in the region of the dust chamber, for reception of spare parts. The compartment is closable by a cover, which in the closed state is matched to the housing base to be flush. For opening the cover at the base the vacuum cleaner has to be stood up so that the cover attached by means of hinges in the motor chamber region of the vacuum cleaner base can be pivoted open and a spare part removed. It is disadvantageous with respect thereto that the vacuum cleaner has to be set from its normal operating position into a vertical position before the cover is accessible for opening the compartment.

It is the object of the invention to develop a vacuum cleaner according to category in such a manner that a user can easily remove accessories from a receiving chamber arranged below the dust chamber or below the fan chamber. In particular, the user shall be able to remove the accessories without having to take the vacuum cleaner out of its normal operating position.

According to the invention this object is fulfilled in that at least one opening, by way of which the receiving chamber for accessories is accessible, is provided in a side wall of the housing. Thus, accessories located in a receiving chamber below the dust chamber and/or below the fan chamber can be removed when the vacuum cleaner is disposed in its normal operating position. An inconvenient turning over or setting up of the vacuum cleaner is not necessary in order to gain access to the receiving chamber. Moreover, in that case the advantage is obtained that particularly large or bulky accessories, for example even additional suction pipe lengths or suction hoses, can be stored at the vacuum cleaner.

In particular, accessories can be removed even when the vacuum cleaner is in operation. This is not possible in the case of conventional known vacuum cleaners, since the accessories are mostly stored behind a dust chamber flap which closes the dust chamber receiving the dust bag. If the dust chamber cover is opened in the case of this known vacuum cleaner in order to remove an accessory the vacuum cleaner is not operational, since when the dust chamber cover is opened an underpressure cannot be built up in the dust chamber. By contrast thereto, in the case of the vacuum cleaner according to the invention the receiving chamber is constructed separately from the dust chamber so that even when the receiving chamber is opened an underpressure generated in the dust chamber is maintained. The vacuum cleaner according to the invention is thus operationally capable even when the receiving chamber is opened for removal of accessories.

In an advantageous embodiment of the invention the at least one opening is closable by means of a closure part. Since the opening or the openings is or are covered by a closure part, the visual appearance of the vacuum cleaner is maintained. The design of the vacuum cleaner is not disrupted by interruptions in the surface. In particular, the accessories are covered by the closure part and do not feature in the appearance. In addition, the accessories are less dirty when the opening or the openings is or are closed by a closure part and no dust or dirt can get into the receiving chamber. The risk of soiling existed particularly when the vacuum cleaner is operated with uncovered openings, since through movement of the vacuum cleaner on a dirty floor dust and dirt could easily enter a receiving chamber arranged at the base.

In a first alternative the closure part can be constructed as a flap pivotably hinged to the side wall of the housing. If the closure part is constructed as a flap pivotably hinged to the vacuum chamber cover, then a particularly economic closure part can be realised. In the simplest variant, a flap made of plastics material is integrally formed by means of a film hinge directly at a housing consisting of plastics material. Alternatively to pivotable mounting of the flap by means of a film hinge, the flap can also be constructed as a separate component and fastened by way of a hinge, which is attached by one side thereof to the housing and by the other side thereof to the flap, to the side wall of the housing. The flap can have a seal at a side facing the housing. When the flap is closed a gap which possibly still remains between flap and side wall of the housing is sealed off so that no dust can penetrate into the receiving chamber.

In a second alternative the closure part can be constructed as a louvre shutter, which is mounted on the side wall of the housing and displaceable in the plane of the side wall, or as a roller shutter. The construction of the closure part as a displaceable louvre shutter or roller shutter has the advantage that the closure part in the open position does not protrude from the outer contour of the vacuum cleaner. The visual appearance of the vacuum cleaner, even when the closure part is open, is thereby not disturbed. In addition, a louvre shutter left open cannot be damaged during operation of the vacuum cleaner to the high degree possible in the case of a flap left open. Advantageously, the displaceably mounted louvre shutter is guided at each of two opposite ends in a respective guide rail. The guide rails can be fastened along two opposite edges of the opening to extend at the side wall of the housing. The guide rails or the opposite ends of the louvre shutter can have sealing inserts in order to seal off gaps, which may be present, between guide rails and louvre shutter, so that no dust can penetrate into the receiving chamber.

In a preferred embodiment of the invention the receiving chamber extends from a first side wall of the housing to a second side wall, which is opposite the first side wall, of the housing. Due to the fact that the receiving chamber extends from one side wall to the opposite side wall of the housing, there is created a largest possible receiving chamber in which also large accessories, such as, for example, additional suction pipes or suction hoses, can be stored.

In an advantageous construction two openings arranged at opposite side walls of the housing are provided. Two opposite openings are particularly advantageous, since the accessories can be introduced into the receiving chamber from one side and removed from the receiving chamber from the other side. In particular, a long accessory can be pushed out by way of one opening in the side wall, in that the accessory is pushed against from the opposite opening. The accessory is thus easily removable. Particularly in the case of smooth-walled suction pipes it is more advantageous to push against the suction pipe from one end than to have to pull it out from the opposite side. A higher risk of slipping exists in the case of pulling on the smooth-walled suction pipe than in the case of pushing on one end.

Figure 2:
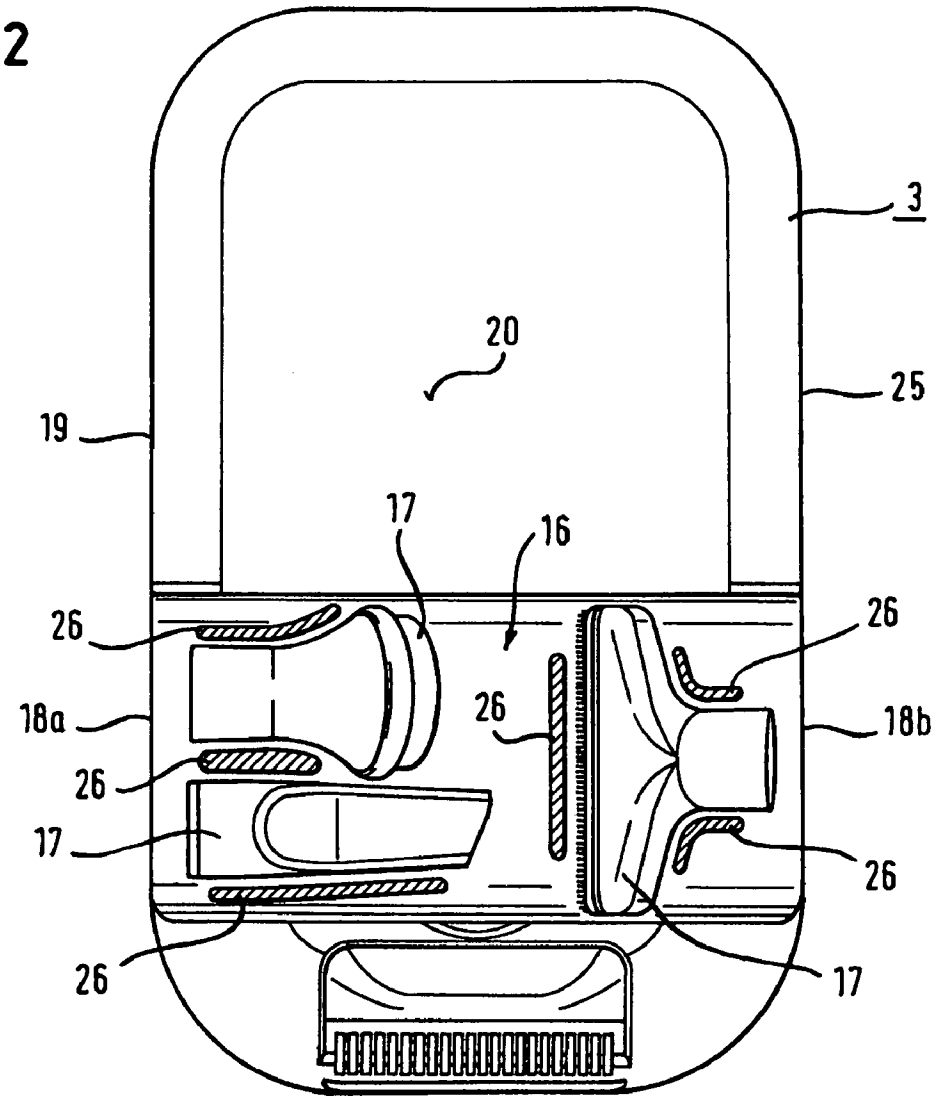

The invention is explained in more detail in the following on the basis of an example of embodiment, wherein:

FIG. 1 shows a vacuum cleaner according to the invention in perspective view; and FIG. 2 shows a schematic illustration of the interior space of the vacuum cleaner of FIG. 1.

A vacuum cleaner shown in FIG. 1 comprises a housing 1 which consists of an upper part 2 and a lower part 3. The upper part 2 carries at a forward end a coupling member into which a stub pipe of a suction hose (not illustrated) can be introduced. A dust chamber 5 is formed at the front end below the upper part 2. A dust filter bag 6 is held within the dust chamber 5. The opening of the dust filter bag 5 is connected with the coupling member 5. A fan chamber 7 is arranged behind the dust filter bag 5 at the rearward end of the vacuum cleaner below the upper part 2. A motor-fan unit 8 is fastened in the housing 1 within the fan chamber 7. The motor-fan unit 8 is supplied with electrical current by way of a mains cable 9 with a mains plug 10. The mains cable 9 can be wound up on a cable winding device 11 fastened in the housing 1. The mains cable 9 goes by way of a cable outlet opening 12, which is integrally formed at the lower part 3, into the outside free space. An intermediate wall 13, which has a suction opening 14, is arranged between fan chamber 7 and dust chamber 5. The motor-fan unit 8 is connected by the underpressure side thereof with the suction opening 14. An underpressure is produced in the dust chamber 5 by way of the suction opening 14 in the intermediate wall 13. Dust-laden air is conducted by way of the coupling member 4 into the dust filter bag 6 by virtue of the underpressure produced in the dust chamber 5. The air freed of dust passes by way of the suction opening 14 into the fan of the motor-fan unit 8. The air is subsequently conducted via slat-like air outlet slots 15 into the outside free space.

A receiving chamber 16 for accessories 17 is constructed in the lower part 3 below the dust chamber 5. The accessories 17 can, selectably, be loosely stored in the receiving chamber 16 or attachably fastened to the lower part 3 by means of retaining elements (not illustrated). The receiving chamber 16 is accessible by way of an opening 18 in the lower part 3. The opening 18 extends to at least one side wall 19 of the lower part 3. In the illustrated example of embodiment the opening 18*a* extends not only on the side wall 19, but also along the base 20 of lower part 3 towards an opposite side wall of the lower part 3. An opening 18*b*, which does not extend over the base 20 of the lower part 3, but is arranged merely within the side wall 19, can also be provided in the side wall 19. The side wall 18*b* enables access to a receiving chamber 16*b* arranged below the fan chamber 7. Receiving chamber 16*a* and receiving chamber 16*b* can also be of integral construction, i.e. go over into one another, wherein a single receiving chamber 16 is formed and is accessible not only by way of the opening 18*a*, but also by way of the opening 18*b*.

The opening 18*a* is, in the illustrated example of embodiment, closable by a louvre shutter 21. The louvre shutter 21 is mounted to be displaceable in the plane of the side wall 19. The opening 18*b* is closable by means of a flap 22 integrally formed at the lower part. The flap 22 is made, just like the lower part, from plastics material. The flap is pivotably fastened to the lower part 3 by means of a film hinge 23. A handle 24 arranged in the front region of the vacuum cleaner serves for standing up and carrying the vacuum cleaner by hand.

FIG. 2 schematically shows the position of the receiving chamber 16 in the lower part 3. The lower part has the side wall 19 on one longitudinal side and a further side wall 25 at the opposite side. The opening 18*a* is arranged in the side wall 19. The second opening 18*b* is arranged in the side wall 25. The accessories 17 are held in holders 26 in the receiving space 16 and removable from the lower part 3 by way of the openings 18*a* and 18*b*.

The invention claimed is:

1. A vacuum cleaner comprising a housing, in which a dust chamber, which is closable by a dust chamber cover, for reception of a dust separator and a fan chamber for reception of a motor-fan unit are constructed and which has a receiving chamber for accessories, which extends below at least one of the dust chamber and the fan chamber and is accessible by way of at least one opening in the housing, wherein the at least one opening is provided in a side wall of the housing.

2. The vacuum cleaner according to claim 1, wherein the at least one opening is closable by means of a closure part.

3. The vacuum cleaner according to claim 2, wherein the closure part includes a flap pivotably hinged to the side wall of the housing.

4. The vacuum cleaner according to claim 2, wherein the closure part includes a louver shutter mounted at the side wall of the housing and displaceable in the plane of the side wall.

5. The vacuum cleaner according to claim 1, wherein the receiving chamber extends from a first side wall of the housing up to a second side wall, which is opposite the first side wall of the housing.

6. The vacuum cleaner according to claim 5, wherein two openings arranged at opposite walls of the housing are provided.

7. A vacuum cleaner comprising:

a housing having a base and a side wall extending upwardly from the base, the vacuum cleaner resting on the base during normal operation of the vacuum cleaner;

a dust chamber disposed within the housing and retaining a dust collector;

a receiving chamber disposed within the housing below the dust chamber for receiving vacuum cleaner accessories; and an opening at least partially defined by the side wall and providing access to the receiving chamber during normal operation of the vacuum cleaner.

8. The vacuum cleaner according to claim 7, further comprising a fan chamber disposed within the housing and retaining a motor fan unit, the receiving chamber disposed below the fan chamber.

9. The vacuum cleaner according to claim 7, wherein the base of the housing at least partially forms the receiving chamber.

10. The vacuum cleaner according to claim 7, wherein the vacuum cleaner accessories are removable from the receiving chamber through the opening during normal operation of the vacuum cleaner.

11. The vacuum cleaner according to claim 7, wherein the housing includes a second side wall extending upwardly from the base and disposed opposite the side wall, the side wall and the second side wall both at least partially defining the receiving chamber.

12. The vacuum cleaner according to claim 11, wherein the opening extends at least partially along the side wall, across the base, and at partially along the second side wall.

13. The vacuum cleaner according to claim 11, further comprising a second opening at least partially defined by the second side wall and providing access to the receiving chamber during normal operation of the vacuum cleaner.

14. The vacuum cleaner according to claim 7, further comprising a dust chamber cover being movable between an open condition, in which access is provided to the dust chamber, and a closed condition, in which the dust chamber is closed, the dust chamber cover being in the closed condition during normal operation of the vacuum cleaner.

15. The vacuum cleaner according to claim 7, further comprising a closure part that is movable relative to the housing to open and close the opening.

16. The vacuum cleaner according to claim 15, wherein the closure part includes a flap pivotably hinged to the side wall of the housing.

17. The vacuum cleaner according to claim 15, wherein the closure part includes a louver shutter mounted at the side wall of the housing and being displaceable with respect to the housing in the plane of the side wall.

18. A vacuum cleaner comprising:

a housing having a base and first and second side walls extending upwardly from the base and disposed opposite one another, the vacuum cleaner resting on the base during normal operation of the vacuum cleaner;

a dust chamber disposed within the housing and retaining a dust collector;

a receiving chamber disposed within the housing below the dust chamber and extending from the first side wall to the second side wall, the receiving chamber receiving vacuum cleaner accessories to be stored within the housing;

an opening at least partially defined by the side wall and providing access to the receiving chamber during normal operation of the vacuum cleaner; and a closure part that is movable relative to the housing to open and close the opening.

19. The vacuum cleaner according to claim 18, wherein the closure part includes a flap pivotably hinged to the side wall of the housing.

20. The vacuum cleaner according to claim 18, wherein the closure part includes a louver shutter mounted at the side wall of the housing and being displaceable with respect to the housing in the plane of the side wall.

21. The vacuum cleaner according to claim 1, wherein the receiving chamber extends from a first side wall of the housing toward a second side wall along a lateral extent of the receiving chamber and the lateral extent of the receiving chamber is sufficient to store a first accessory and a second accessory with the first accessory being laterally intermediate the second accessory and the opening.

22. The vacuum cleaner according to claim 21, wherein the receiving chamber has an access opening and further comprising a louver shutter mounted at the side wall of the housing, the louver shutter being displaceable with respect to the housing in the plane of the side wall to selectively permit access to, and prevent access to, the receiving chamber.

23. The vacuum cleaner according to claim 1, wherein the receiving chamber has an access opening and further comprising a louver shutter mounted at the side wall of the housing, the louver shutter being displaceable with respect to the housing in the plane of the side wall to selectively permit access to, and prevent access to, the receiving chamber.

* * * * *